US007020543B1

(12) United States Patent
Jaeschke et al.

(10) Patent No.: US 7,020,543 B1
(45) Date of Patent: Mar. 28, 2006

(54) CONTROLLER FOR FUEL FIRED HEATING APPLIANCE

(75) Inventors: Horst E. Jaeschke, Imperial, MO (US); Andrew Juengst, St. Louis, MO (US)

(73) Assignee: Emerson Electric, Co., St. Louis, MO (US)

( * ) Notice: Subject to any disclaimer, the term of this patent is extended or adjusted under 35 U.S.C. 154(b) by 0 days.

(21) Appl. No.: 10/963,362

(22) Filed: Oct. 12, 2004

(51) Int. Cl.
*G06F 19/00* (2006.01)

(52) U.S. Cl. ..... 700/275; 700/29; 219/497

(58) Field of Classification Search ..... 700/276, 700/29, 275; 236/1 A–1 C; 126/376, 41 R; 219/497, 263
See application file for complete search history.

(56) References Cited

U.S. PATENT DOCUMENTS 6,129,284 A * 10/2000 Adams et al. ..... 236/21 R
6,728,600 B1 * 4/2004 Contaldo et al. ..... 700/274
2004/0060924 A1 * 4/2004 Burkhart ..... 219/497

* cited by examiner

*Primary Examiner*—Kidest Bahta
(74) *Attorney, Agent, or Firm*—Harness Dickey & Pierce; Kevin Pumm

(57) ABSTRACT

A controller for a fuel-fired appliance comprising a microprocessor that is able to detect an interruption in power, and immediately store errors and historical diagnostic information in a non-volatile memory before the microprocessor powers down. Upon restoration of power, the microprocessor would flash or display the most recent error codes on the controller's diagnostic LED or display. The microprocessor is also able to detect an open fuse condition, and flash or display the fuse error on the display.

28 Claims, 1 Drawing Sheet

CONTROLLER FOR FUEL FIRED HEATING APPLIANCE

BACKGROUND OF THE INVENTION

The present invention is generally related to fuel-fired heating appliances, and more specifically to a controller for a fuel-fired heating appliance capable of communicating diagnostic information.

Many control systems for controlling the operation of fuel-fired heating appliances have the capability of reporting diagnostic information relating to various components in the appliance. Some of these controllers also include a fuse for providing over-current protection for the controller and other electrical components of the appliance system. While such controllers included a field-replaceable fuse to protect the controller from mis-wiring or overload, these controllers were subsequently disabled when the fuse was blown or opened. Consequently, the control was unable to report diagnostic information concerning the open fuse or other appliance errors to a service technician. Furthermore, the prior art devices could not store diagnostic information if power to the control was interrupted. Thus diagnostic information was not available, even upon restoration of power. In an example of a fuel-fired furnace having a safety switch that disconnects power to the control when the service panel is opened, the control would lose diagnostic information when a technician opened the service panel to better view the control's diagnostic display. For the technician attempting to service a disabled furnace in which dirt accumulation was inhibiting visible access of the diagnostic display, a solution to this problem would be very helpful.

SUMMARY OF THE INVENTION

There is provided, in accordance with one embodiment of the invention, a controller for a fuel-fired appliance that comprises a microprocessor for controlling the operation of the appliance, a low voltage power supply in connection with a power source for the appliance, a fuse in connection with the power source for the appliance and connected in parallel with the low voltage power supply, wherein the appliance is connected to the power source though the fuse. The microprocessor of the apparatus is connected across the fuse in a manner such that the microprocessor is capable of detecting an open fuse state. The fused appliance circuit provides power to various electrical controls and components of the appliance, which would lose power in the event of the fuse blowing or opening. The apparatus responsively communicating a diagnostic error signal to the display means indicating an open fuse state.

In one aspect of the present invention, some embodiments provide fused protection for the appliance and controller, and also to provide improved diagnostic features for both the appliance manufacturer and the service technician.

In another aspect of the present invention, some embodiments may comprise a microprocessor that is capable of detecting an interruption in the supply of power to the controller and responsively storing diagnostic information in the non-volatile memory. Upon restoration of power, the microprocessor can retrieve diagnostic information from the non-volatile memory and communicate the corresponding diagnostic error codes to the display means. The controller of the present invention thereby provides improved diagnostic features for both the appliance manufacturer and the service technician.

In yet another aspect of the present invention, some embodiments can provide historical diagnostic information relating to the operation of a fuel-fired appliance immediately upon power-up of the controller, to provide trouble-shooting assistance.

These and other features and advantages of the present invention will become apparent from the following detailed description of a preferred embodiment of a fuel-fired appliance controller which illustrates by way of example the principles of the present invention.

DETAILED DESCRIPTION OF THE INVENTION

Figure 1:
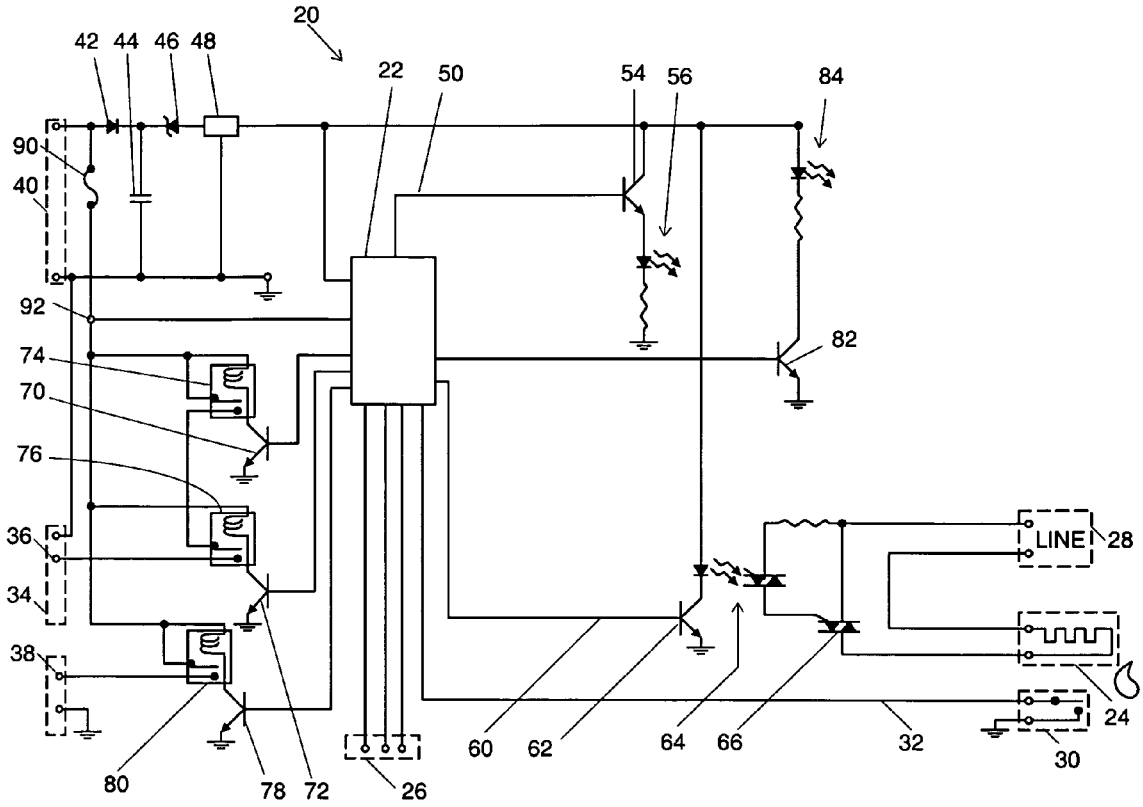
FIG. 1 is schematic diagram of one embodiment of a controller according to the principles of the present invention.

One preferred embodiment of a controller for a fuel-fired appliance according to the principles of the present invention is illustrated in FIG. 1, and comprises a microprocessor 22 in connection with a 5 volt power supply, which is connected to a 24 vac power source 40. The controller generally shown at 20 further comprises a fused circuit 92 connected to the 24 vac power source 40. The controller is also connected to various components including a thermostat 26, a pressure switch 30, an igniter 24, and a gas valve 34. The fused appliance circuit at 92 and the 5 volt power supply circuit are connected in parallel to the 24 vac power source 40 in a manner such that the fuse 90 can protect the appliance controls and components from miss-wiring while still allowing the 5 volt power supply to provide power to the microprocessor 22 of the controller 20.

The power supply for the controller's microprocessor 22 is preferably a half-wave regulated 5 volt power supply, which is supplied by a 24 vac power source 40. The 5 volt power supply comprises a diode 42 and a zener diode 46 in series with a voltage regulator 48, and also a regulating capacitor 44. The controller 20 also comprises a relay switching means 80 for switching power to a blower motor (via connections shown at 38). When receiving a request signal for heating from the thermostat 26, the microprocessor 22 drives a transistor 78 to activate relay switch 80 to turn on the blower motor. When a sufficient level of air flow is established by the blower, the pressure switch 30 will close. The microprocessor 22 monitors the closure of the pressure switch 30, before switching power to an igniter 24 for igniting the supply of fuel. When the igniter 24 has been sufficiently warmed up, the microprocessor 22 outputs a signal to activate the gas valve 34 to initiate the supply of gas to be ignited.

The microprocessor 22 of the present invention is preferably a ST72C334 microprocessor manufactured by ST Microelectronics. The microprocessor 22 initiates the start of the blower motor upon a call for heat from the thermostat 26. The microprocessor 22 also determines an on-off sequence for switching line voltage to the igniter 24 that will power or heat up the igniter to a level sufficient to ignite gas. Specifically, the microprocessor 22 outputs a signal 60 that drives a transistor 62 to switch an opto-traic switch 64 on and off. The opto-triac 64 gates a triac 66 for switching 120 vac line voltage 28 to the igniter 24. When the pressure switch 30 closes indicating sufficient air flow and the igniter 32 has heated up, the microprocessor 22 drives transistors 70 and 72 for switching a pair of redundant relays 74 and 76 to a closed position to actuate the main valve 36 of the gas valve 34. This initiates the supply of gas to the igniter 24, to establish flame for heating. When the thermostat 26 is satisfied and ends the call for heat, the microprocessor 22 shuts off the gas valve relays 74 and 76 and blower relay 80.

In the event the fuse 90 should blow or open as a result of mis-wiring, shorting, or an over-current condition in one of the appliance components, the microprocessor 22 is capable of detecting the open fuse state via a connection at node 92. Upon detecting the open fuse, the microprocessor 22 responsively outputs a 4800 baud rate signal at 50 that gates a transistor 54 on and off. The transistor 54 switches voltage on and off to a communication means for sending diagnostic information pertaining to the open fuse condition external to the control. In the preferred embodiment, the communication means comprises an LED 56, but may also be a connector for transmitting a data stream to an external device. The flashing signal provided by the LED 56 is capable of being read by a Light Port reader (not shown), which may be incorporated into a computer or palm device that is used by a service technician. The microprocessor may also communicate historical diagnostic information to the LED 56, which may be received and analyzed by the service technician. While the microprocessor 22 is communicating historical information, the microprocessor 22 gates on a transistor 82 for turning on a second LED 84, which is used as an indicator light to alert the technician of when the LED 56 is communicating historical diagnostic information rather than diagnostic error information.

In the event of an interruption of power supplied to the controller 20, the microprocessor 22 detects the loss of power and stores any recent error codes and historical diagnostic information in a non-volatile memory within the microprocessor 22. An interruption in power may be caused by an event external to the controller 20, or may also be caused by the fuse 90 opening. It should also be noted that the microprocessor 22 also periodically stores diagnostic information into memory, independent of any interruption in power. In the preferred embodiment, the non-volatile memory is an EEPROM memory included in the microprocessor 22, but may alternatively be a separate EEPROM chip in connection with the microprocessor 22. Upon restoration of power to the controller 20, the microprocessor 22 retrieves the recent error codes from the EEPROM memory. The microprocessor 22 then communicates a signal incorporating the diagnostic error information to the LED. Specifically, the LED may be flashed on and off a predetermined number of times, or may be powered on continuously to indicate an open fuse error code. Likewise, the LED may be flashed on another predetermined number of times to indicate a failed ignition attempt error code, and yet another predetermined number of times to indicate a failure of the pressure switch to close. The microprocessor 22 may also communicate historical diagnostic information to the LED 56 that pertains the number of occurrences of the pressure switch failing to close, and/or the number of unsuccessful ignition attempts in a predetermined number of heating cycles. The microprocessor may also be configured to communicate historical diagnostic information only when prompted by a service technician. Upon receiving a request input, the microprocessor 22 activates the second LED 84 to indicate communication of historical diagnostic information, and then flashes the LED 56 to provide a signal to a LED reader used by the service technician. Alternatively, the microprocessor may communicate the diagnostic information through a connector or some other means for transmitting information external to the control. It should be evident that the above method of communicating diagnostic information to an LED may include any combination of diagnostic error signals pertaining to the operation of a fuel-fired appliance.

It should be noted that the method of displaying the diagnostic errors or information using an LED may alternatively be performed using an LCD display or other display means in place of the LED. The LCD display would be able to display a text message or a number indicating a diagnostic error code. The LCD display would further be able to indicate when historical diagnostic information is being displayed, to provide differentiation from diagnostic error codes or information. Likewise, the communication of diagnostic information to an external reader may also be accomplished in an alternative manner, such as through wireless RF or infrared communication signals to a computer or palm device.

The foregoing represents a preferred embodiment only, and the invention is not to be limited by the description and drawings. Additional design considerations, readily apparent to one of ordinary skill in the art, such as the modification of the controller to display diagnostic information on an LCD, may provide similar or enhanced function. It should be apparent to those skilled in the art that various modifications such as the above may be made without departing from the spirit and scope of the invention. More particularly, the apparatus may be adapted to any of a variety of gas fired appliances including clothes dryers and furnaces. Accordingly, it is not intended that the invention be limited by the particular form illustrated and described above, but by the appended claims.

What is claimed is:

1. A controller for controlling a fuel fired heating appliance, the controller comprising:

a microprocessor for controlling the operation of the appliance, the microprocessor being capable of detecting an interruption in power and responsively storing diagnostic information in a non-volatile memory such that the microprocessor is able to retrieve the stored diagnostic information upon restoration of power;

a low voltage power supply in connection with a power source for the appliance, the low voltage power supply being in connection with the microprocessor;

a fuse in connection with the power source for the appliance, wherein the fuse is connected in parallel with the low voltage power supply such that the appliance is connected to the power source though the fuse but the low voltage power supply and microprocessor are not connected to the power supply through the fuse; and wherein the microprocessor is connected across the fuse in a manner such that an open fuse state does not interrupt power to the microprocessor, and the microprocessor is capable of detecting the open fuse state.

2. The controller of claim 1, further comprising a display means for communications diagnostic information, and wherein upon detection of an open fuse state the microprocessor responsively sends a diagnostic error signal indicating the open fuse state to the display means.

3. The controller of claim 2, wherein the microprocessor further comprises a non-volatile memory, wherein the microprocessor is capable of detecting an interruption in the supply of power to the controller and responsively stores diagnostic information in the non-volatile memory of the microprocessor.

4. The controller of claim 3, whereupon power-up of the controller the microprocessor retrieves diagnostic information from the non-volatile memory and immediately communicates the corresponding diagnostic error codes to the display means.

5. The controller of claim 2, wherein the display means comprises an LED.

6. The controller of claim 5, wherein the LED is switched on and off at a baud rate that is capable of optically communicating information to an LED reading device.

7. The controller of claim 2, wherein the display means comprises an LCD display.

8. The controller of claim 7 wherein the LCD display indicates when the display means is communicating diagnostic error codes and when the display means is communicating historical diagnostic information.

9. The controller of claim 2, wherein the controller comprises a second LED, wherein the microprocessor activates the second LED to indicate that the display means is communicating historical diagnostic information.

10. A controller for controlling a fuel fired heating appliance having a display means for communicating diagnostic information, the controller comprising:

a microprocessor for controlling the operation of the appliance, the microprocessor being capable of detecting an interruption in power and responsively storing diagnostic information in a non-volatile memory such that the microprocessor is able to immediately retrieve and communicate the diagnostic information upon restoration of power;

a low voltage power supply in connection with a power source for the appliance, the low voltage power supply being in connection with the microprocessor;

a fuse in connection with the power source for the appliance, wherein the fuse is connected in parallel with the low voltage power supply such that the appliance is connected to the power source though the fuse but the low voltage power supply and microprocessor are not connected to the power supply through the fuse; and wherein the microprocessor is connected across the fuse in a manner such that an open fuse state does not interrupt power to the microprocessor, and the microprocessor is capable of detecting an open fuse state and responsively communicates a diagnostic error signal to the display means indicating an open fuse state.

11. The controller of claim 10, wherein the microprocessor further comprises a non-volatile memory, wherein the microprocessor is capable of detecting an interruption in the supply of power to the controller and responsively storing diagnostic information in the non-volatile memory.

12. The controller of claim 11, where upon power-up of the controller the microprocessor retrieves stored diagnostic information from the non-volatile memory and immediately communicates at least one diagnostic error code to the display means.

13. The controller of claim 10, wherein the display means comprises an LED.

14. The controller of claim 13, wherein the LED is switched on and off at a baud rate that is capable of optically communicating information to a light port device.

15. The controller of claim 12, wherein the controller comprises a second LED, wherein the microprocessor activates the second LED to indicate that the display means is communicating historical diagnostic information.

16. The controller of claim 10, wherein the display means comprises an LCD display.

17. The controller of claim 16, wherein the LCD display indicates when the display means is communicating diagnostic error codes and when the display means is communicating historical diagnostic information.

18. A controller having a non-volatile memory and a display means for communicating diagnostic information relating to a fuel fired heating appliance, the controller comprising:

a microprocessor for controlling the operation of the appliance, the microprocessor being capable of storing diagnostic information in a non-volatile memory before an interruption in power, such that the microprocessor may retrieve the diagnostic information upon restoration of power;

a low voltage power supply in connection with the microprocessor and a power source for the appliance and a fuse is connected in parallel with the low voltage power supply such that the appliance is connected to the power source though the fuse but the low voltage power supply and microprocessor are not connected to the power supply though the fuse;

wherein after an interruption of power and a restoration of power the microprocessor immediately retrieves stored diagnostic information from the non-volatile memory and immediately communicates at least one diagnostic error code to the display means.

19. The controller of claim 18, wherein the controller further comprises a fuse in connection with the power source for the appliance and connected in parallel with the low voltage power supply, so that the appliance is connected to the power source though the fuse.

20. The controller of claim 19, wherein the microprocessor is connected across the fuse in a manner such that the microprocessor is capable of detecting an open fuse state and responsively communicating a diagnostic error signal to the display means indicating an open fuse state.

21. The controller of claim 18, wherein the display means comprises an LED.

22. The controller of claim 21, wherein the LED is switched on and off at a baud rate that is capable of optically communicating information to a light port device.

23. The apparatus of claim 22, wherein the controller comprises a second LED, wherein the microprocessor activates the LED to indicate that the display means is communicating historical diagnostic information.

24. The apparatus of claim 18, wherein the display means comprises an LCD display.

25. The apparatus of claim 24, wherein the LCD display indicates when the display means is communicating diagnostic error codes and when the display means is communicating historical diagnostic information.

26. A method of controlling the operation of a fuel fired appliance with a controller having a non-volatile memory, a display means for communicating diagnostic information, the method comprising the steps of:

a fuse in connection with a power source for the appliance wherein the appliance is connected to the power source though the fuse but a low voltage power supply and microprocessor are not connected to the power supply though the fuse;

detecting an interruption in the supply of power to the controller;

the microprocessor responsively storing diagnostic information in the non-volatile memory of the controller before power to the controller is interrupted; retrieving the diagnostic information stored in the non-volatile memory upon restoration of power after the interruption; and immediately communicating the most recent diagnostic error information to the display means.

27. The method of claim 26 further comprising the steps of the microprocessor detecting an open fuse state, and responsively communicating a diagnostic error signal to the display means indicating an open fuse state.

28. The method of claim 27, further comprising the step the display means further providing indication of when the display means is communicating historical diagnostic information.

* * * * *